US005526751A

United States Patent [19]

Spivey et al.

[11] Patent Number: 5,526,751

[45] Date of Patent: Jun. 18, 1996

[54] FLARE WITH ANNULAR SEAL

[75] Inventors: James R. Spivey, Irvine, Calif.; William F. Brice, Feeding Hills, Mass.; William J. Dee, Chino, Calif.

[73] Assignee: Skyblazer, Inc., Anaheim, Calif.

[21] Appl. No.: 400,794

[22] Filed: Mar. 8, 1995

[51] Int. Cl.[6] ..... F42B 4/26

[52] U.S. Cl. ..... 102/341; 102/342; 102/358

[58] Field of Search ..... 102/341, 342, 102/343, 357, 358

[56] References Cited

U.S. PATENT DOCUMENTS

| | | | |
|---|---|---|---|
| 3,760,729 | 9/1973 | Freeman | 102/32 |
| 3,910,190 | 10/1975 | Dare | 102/37.4 |
| 3,954,059 | 5/1976 | Langseth | 102/37.8 |
| 4,335,656 | 6/1982 | Beatty et al. | 102/340 |
| 5,331,897 | 7/1994 | Handler | 102/341 |

*Primary Examiner*—Peter A. Nelson

*Attorney, Agent, or Firm*—Frank J. Uxa

[57] ABSTRACT

A flare including a body, an ignitable projectile in the body, an igniter for initiating ignition of the ignitable projectile and initiating propulsion of the projectile out one end of the body, a cap removably coupled to the other end of the body and an ignition member in the body and the cap which can be pulled to ignite the igniter composition. The flare also includes a safety shield at least partially receiving the body and the cap and being releasably retained against substantial axial movement relative to the body in a retracted position to inhibit removal of the cap from the body and being responsive to a force to move relative to the body and cap to an extended position. Confronting surfaces of the shield and cap are configured to provide a passage for water to escape from a region between the shield and the body. The end of the shield adjacent the body is configured to provide a plurality of resilient fingers. A cooperating projection and recess on the fingers and the body releasably retain the shield in the retracted position. An annular seal is provided between the cap and body and the cap has an end face configured to retain the seal.

14 Claims, 2 Drawing Sheets

FLARE WITH ANNULAR SEAL

BACKGROUND OF THE INVENTION

This invention relates to a flare of the type which can be actuated to provide a distress or location signal. One prior art flare of this type includes a body and an ignitable projectile in the body. When the flare is actuated, the projectile is ignited and is fired into the air with the burning projectile providing the distress signal.

In one prior art flare of this type, the flare also includes an igniter composition for initiating ignition of the ignitable projectile and for initiating propulsion of the projectile out of one end of the body. A cap is removably coupled to the other end of the body and an ignition member in the body and the cap can be pulled to ignite the igniter composition. To reduce the likelihood of tampering with the flare and possible inadvertent ignition, a safety or tamper resistant shield is provided. The safety shield at least partially receives the body and the cap with opposite ends of the shield being adjacent the cap and body, respectively. The shield is releasably retained against substantial axial movement relative to the body in a retracted position to thereby inhibit removal of the cap from the body. The shield is responsive to a force to move relative to the body and cap to an extended position so that removal of the cap from the body is facilitated.

Although a flare of this type functions satisfactorily, it is possible for water to get inside the shield, i.e. between confronting surfaces of the shield and the body. This may occur, for example, during a heavy rain or when the flare is used to provide a distress signal by someone who is in the water. It is preferred not to fire the flare through water in the shield.

In order for the flare to be actuated, it is necessary to move the shield to the extended position. This can also be more difficult to accomplish by someone in the water who has nothing readily available against which to strike the flare to obtain the desired relative movement between the body and the shield.

SUMMARY OF THE INVENTION

This invention provides certain improvements over the prior art flare described above. One such improvement is a passage for water to escape from the shield. The invention also provides a feature which facilitates movement of the shield to the extended position. In addition, the interface between the cap and body is sealed to make it more difficult for water to enter the body and contact the burnable parts of the flare which might prevent the flare from firing.

In order to provide for the escape of water from the shield, an inner surface of the shield and outer surfaces of at least one of the cap and body are appropriately configured to provide the passage for the escape of water. In a preferred construction, the inner surface of the shield has at least one groove which forms all or a portion of the water escape passage. In a more preferred embodiment, the inner surface of the shield has a plurality of grooves which extend toward an end of the shield to provide all or a portion of the water escape passage. Thus, when the flare is held with the discharge end of the body pointing upwardly, water can drain from the shield through the water escape passage.

In order to facilitate movement of the shield to the extended position, a positive and reliably releasable detent is provided, and this feature can be provided with or without the water drain passage feature discussed above. To provide this kind of detent, the flare includes a plurality of resilient fingers on the shield adjacent an end of the shield and a cooperating projection and recess on the fingers and the body so that the shield is releasably retained in the retracted position. The resilience of the fingers allows the projection to be reliably forced out of the recess to enable the shield to be moved to the extended position where the flare can be fired in the usual manner.

In a preferred construction, the shield has a plurality of slots in an end of the shield to define the fingers. Although the projection can be on either the fingers or the body, preferably the projection includes a rib on the fingers and the groove is on the body.

To reduce the likelihood that water will contact the burnable portions of the flare, a seal is provided between the cap and the body, and this feature can be provided with or without either or both of the water drainage feature and the detent feature discussed above. To retain the seal in position, the cap has a seal retaining surface and the body has an annular surface cooperating with the seal retaining surface to define an annular seal groove for the seal. In a preferred construction, the seal retaining groove is on an end face of the cap and is concavely curved to prevent extrusion of the seal radially outwardly. The curved surface is readily moldable and avoids stress concentrations.

The invention, together with additional features and advantages thereof may best be understood by reference to the following description taken in connection with the accompanying illustrative drawings.

DESCRIPTION OF THE PREFERRED EMBODIMENT

Figure 1:
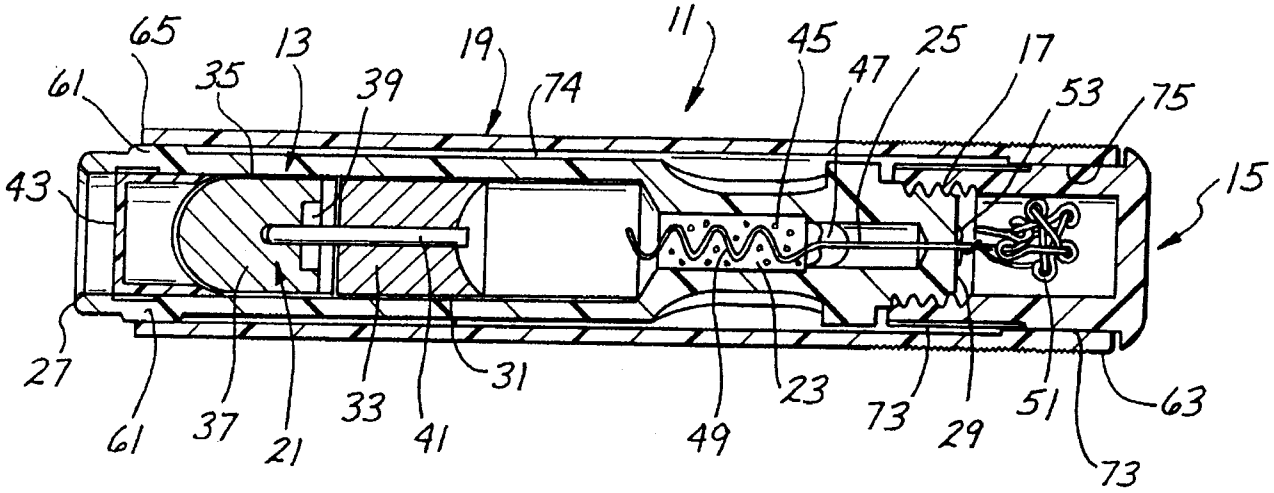
Fig. 1 PRIOR ART
FIG. 1 is a longitudinal sectional view of a prior art flare with the shield in the retracted position.

FIG. 1 shows a prior art flare 11 which generally comprises a body 13, a cap 15 removably attached to one end of the body by screw threads 17 and a shield 19 partially receiving the body and the cap. The flare 11 also includes an ignitable projectile 21 within the body, an igniter composition 23 for initiating ignition of the ignitable projectile and initiating propulsion of the projectile out one end of the body, and an ignition member 25 in the body and the cap 15 which can be pulled to ignite the igniter composition 23.

More specifically, the body 13 is an elongated tubular member of a suitable polymeric material having a distal or muzzle end 27 and a narrow opening at a proximal end 29. The ignitable projectile 21 includes a flare cup 31 containing a flare composition 33, a cup 35 containing a flare composition 37, a cellulose nitrate adhesive 39 for coupling the cup 31 to the flare composition 37 and igniter cord 41 useful in igniting the flare compositions 37 and 33. The distal end 27 is closed by a plug 43 which is preferably sealed to the interior of the body 13.

The igniter composition 23 may include, for example, black powder 45 and igniter composition 47 suitably retained in an igniter cup. The ignition member 25 in the form shown includes an igniter wire 49 which extends through the black powder 45 and igniter composition 47 and an elongated flexible element in the form of a chain 51. The igniter wire 49 extends through the small opening at the proximal end 29 of the body 13 and the opening around the wire is sealed by a suitable adhesive 53. The proximal end of the igniter wire 49 and the chain 51 are retained within the cap 15.

The body 13 has a plurality of integral tabs 61 adjacent the distal end 27. The shield 19, which is in the form of a polymeric sleeve, cooperates with the tabs 61 to frictionally retain the shield in a retracted position shown in FIG. 1. More specifically, the shield 19 has a proximal end 63 adjacent a proximal end of the cap 15 and a distal end 65 which can be forced over the tab 61 to frictionally retain the shield in the retracted position. In the retracted position, substantially all of the cap 15 is received by the shield so that it is difficult to rotate the cap relative to the body to remove it from the body. Because the shield in the retracted position inhibits removal of the cap from the body, the shield makes the flare tamper resistant.

Figure 2:
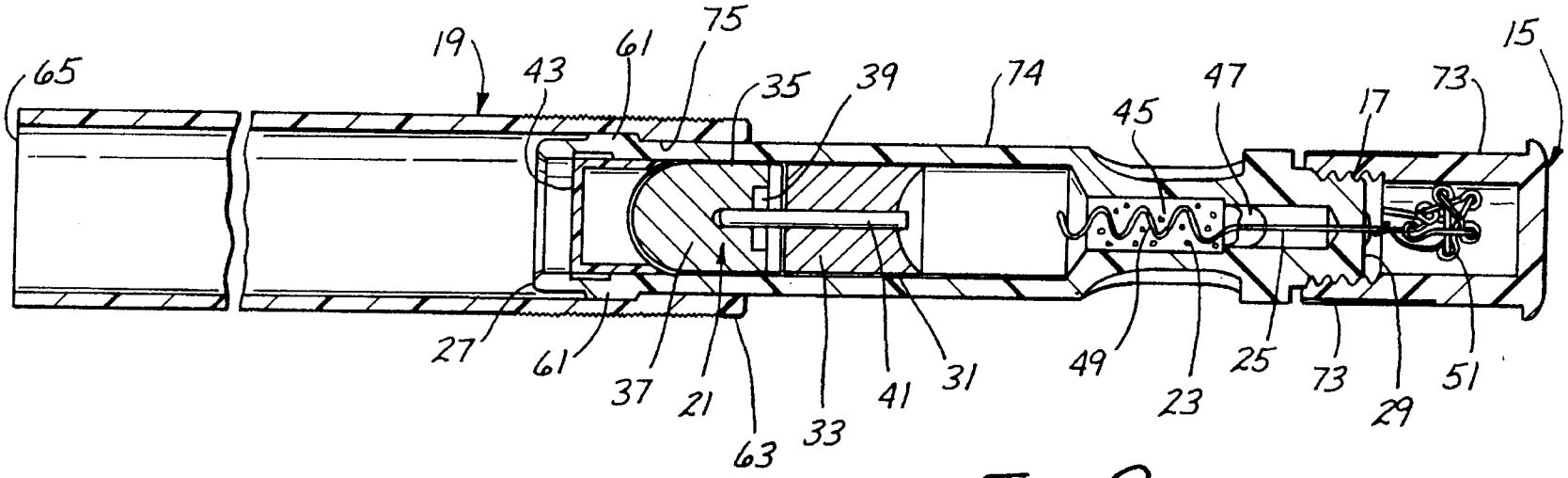
Fig. 2 PRIOR ART
FIG. 2 is a view similar to FIG. 1 of the prior art flare with the shield in the extended position.

To move the shield 19 to the extended position, it must be moved axially relative to the body and the cap to the position shown in FIG. 2 so that removal of the cap 15 from the body is facilitated. This can be accomplished, for example, by banging the distal end 27 against a hard surface to move the body relative to the shield until the distal end 65 moves off of the tabs 61 so that further relative axial movement can be easily accomplished. In the extended position, the cap 15 is removed and the chain 51 is pulled causing the igniter wire 49 to ignite the igniter composition 47 which in turn ignites the black powder 45. The black powder propels the projectile 21 out the distal end 27 of the body 13 in a conventional manner and ignites the flare composition 33. The composition 33 ignites the igniter cord 41 which in turn ignites the composition 37. The burning of the flare compositions 33 and 37, which may be of any appropriate color, provides a visual distress or locator signal. The flare compositions 33 and 37 tend to separate in flight.

In a case of a disaster at sea, it is sometimes necessary for the person carrying the flare to jump into the water before setting off the flare. In this event, there is a likelihood that water will get inside the shield 19 and more specifically into a region 71 between the body 13 and shield 19. If this occurs, outer surfaces 73 and 74 of the cap 15 and body 13 are too closely spaced to an inner surface 75 of the shield 19 to allow any water in the shield 19 to freely escape.

Figure 3:
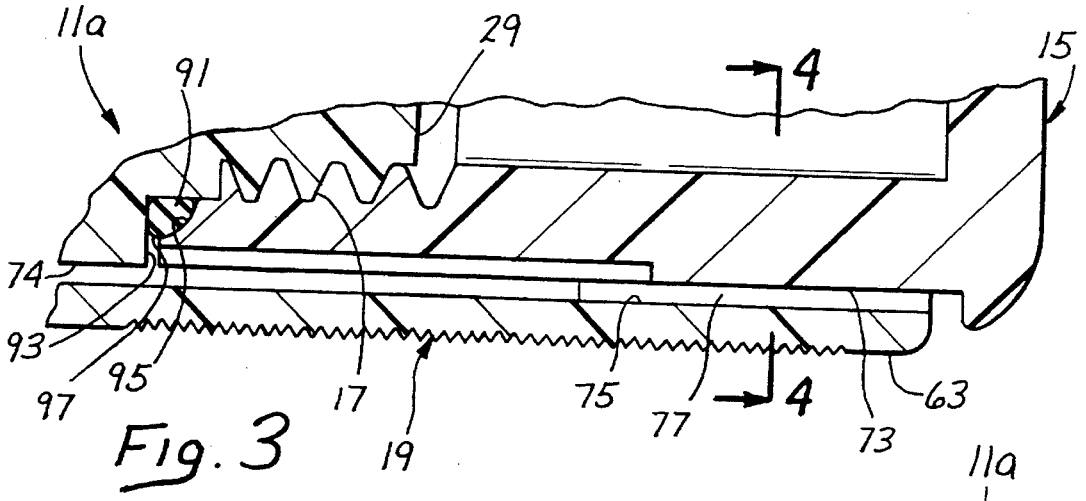
FIG. 3 is an enlarged fragmentary sectional view of the proximal end of the flare of this invention illustrating a preferred construction of the water drainage passage, seal and seal retaining surface of this invention.
Figure 4:
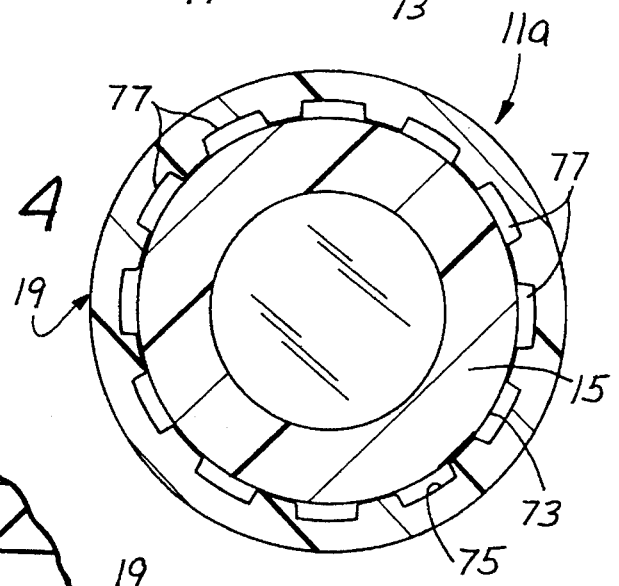
FIG. 4 is a sectional view taken generally along line 4—4 of FIG. 3.

The flare 11*a* of FIGS. 3 and 4 addresses this problem. The flare 11*a* may be identical to the flare 11 in all respects not shown or described herein, and corresponding portions of the flares 11 and 11*a* are designated by corresponding reference characters.

With this invention, the surfaces 73, 74 and 75 are configured to provide a passage for water to escape from within the shield 19 when the shield is in the retracted or extended positions. In a preferred embodiment, the inner surface 75 of the shield 19 has a plurality of axially extending grooves 77 which extend toward the proximal end 63 of the shield. With this construction, the grooves 77 and the outer surface 73 of the cap form a passage through which water can drain from the region 71 in the retracted position, and the grooves 77 and the outer surface 74 form a passage through which water can drain from the shield in the extended position. Although only one of the grooves 77 can be provided if desired, preferably a plurality of the grooves are employed. The grooves 77 should extend to the proximal end 63 and be of sufficient length so that the drainage function can be accomplished.

In using the drainage feature of this invention, the shield 19 is moved to the extended position as shown in FIG. 2 and held in a firing position with the distal end 27 of the body 13 pointed upwardly as the cap 15 is unscrewed. During this time, the grooves 77 allow water to drain from within the shield 19.

The flare 11*a* has features which permit the shield 19 to be releasably retained in the retracted position. To accomplish this, the shield 19 has a plurality of resilient fingers 81 (FIGS. 5 and 6) adjacent the distal end 65 of the shield and a cooperating projection 83 and recess 85. In this embodiment, the projection 83 is in the form of an inwardly extending rib on the fingers 81 and the recess is in the form of an outwardly opening groove on the body 13, and more specifically on each of the tabs 61. In the embodiment illustrated, the shield 19 has a plurality of axially extending slots 87 which extend proximally of the distal end 65 to define the fingers 81. Thus, the fingers are an integral part of the shield 19.

Figure 5:
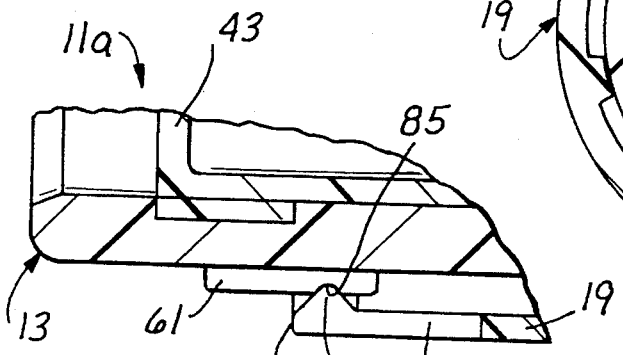
FIG. 5 is an enlarged fragmentary sectional view of a preferred construction of a distal end portion of the flare of this invention.
Figure 6:
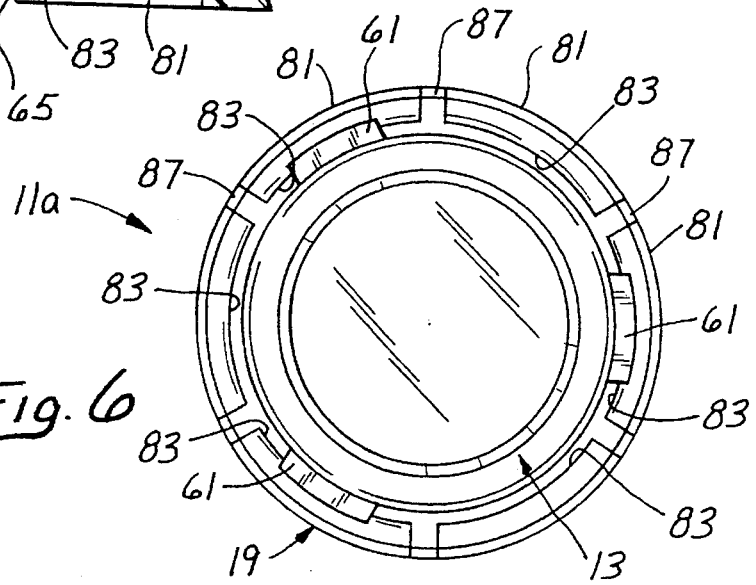
FIG. 6 is an end view of the distal end of the flare of this invention.

In the retracted position of FIG. 5, the projection 83 is received in the recess 85 to releasably retain the shield 19 in the retracted position. However, because of the resilience of the fingers 81, the body 13 and shield 19 can be moved axially to the extended position with the fingers resiliently flexing to allow the projection 83 to slide out of the recess 85 and to allow such movement to occur. Consequently, the shield 19 can be moved to the extended position in a reliable fashion with a more easily predictable force.

Another feature of the flare 11*a* invention is an annular seal 91 (FIG. 3) between the cap 15 and the body 13 to reduce the likelihood of water entry through the cap-body interface. The body 13 has a radial, annular surface 93 and the cap 15 has a seal retaining surface 95 which cooperates with the surface 93 to form an annular seal groove 97. The seal retaining surface 95 is on an end face of the cap 15 and is an annular, concavely curved surface which is useful for capturing the seal 81 and preventing the seal from extruding radially outwardly. Consequently, the seal 81 can be tightly squeezed between the surfaces 93 and 95 to provide a watertight seal.

Although exemplary embodiments of the invention have been shown and described, many changes, modifications and substitutions may be made by one having ordinary skill in the art without necessarily departing from the spirit and scope of this invention.

We claim:

1. In a flare including a body, an ignitable projectile in said body, an igniter composition for initiating ignition of the ignitable projectile and initiating propulsion of the projectile out one end of the body, a cap removably coupled to the other end of the body, an ignition member in the body and the cap which can be pulled to ignite the igniter composition and a safety shield at least partially receiving the body and the cap and having opposite ends with a first of said ends being adjacent the cap, said safety shield being releasably retained against substantial axial movement relative to the body in a retracted position to inhibit removal of the cap from the body and being responsive to a force to move relative to the body and cap to an extended position whereby removal of the cap from the body is facilitated, and the shield having an inner surface and the cap and body having outer surfaces, the improvement comprising:

said inner surface of the shield and at least one of said outer surfaces being configured to provide a passage for water to escape from within the shield.

2. A flare as defined in claim 1 wherein the inner surface of the shield has at least one groove and said passage includes said groove.

3. A flare as defined in claim 1 wherein the inner surface of the shield has a plurality of grooves which extend toward said first end of the shield and said passage includes said grooves.

4. A flare as defined in claim 1 including a seal between the cap and the body.

5. In a flare including a body, an ignitable projectile in said body, an igniter composition for initiating ignition of the ignitable projectile and initiating propulsion of the projectile out one end of the body, a cap removably coupled to the other end of the body, an ignition member in the body and the cap which can be pulled to ignite the igniter composition and a safety shield at least partially receiving the body and the cap and having opposite ends with a first of said ends being adjacent the cap and a second of said ends being adjacent the body, said safety shield being releasably retained against substantial axial movement relative to the body in a retracted position to inhibit removal of the cap from the body and being responsive to a force to move relative to the body and cap to an extended position whereby removal of the cap from the body is facilitated, and the shield having an inner surface and the cap and body having outer surfaces, the improvement comprising:

a plurality of resilient fingers on the shield adjacent the second end of the shield and a cooperating projection and recess on the fingers and the body whereby the shield is releasably retained in said retracted position.

6. A flare as defined in claim 5 wherein the shield has a plurality of slots in said second end to define said fingers.

7. A flare as defined in claim 6 wherein the projection includes a rib on the fingers and the groove is on the body.

8. A flare as defined in claim 5 wherein said inner surface of the shield and at least one of said outer surfaces are configured to provide a passage for water to escape from the shield.

9. A flare as defined in claim 8 including a seal between the cap and the body.

10. A flare as defined in claim 9 wherein the cap has a concavely curved seal retaining surface.

11. A flare as defined in claim 5 including a seal between the cap and the body.

12. A flare as defined in claim 11 wherein the cap has a concavely curved seal retaining surface.

13. In a flare including a body, an ignitable projectile in said body, an igniter composition for initiating ignition of the ignitable projectile and initiating propulsion of the projectile out one end of the body, a cap removably coupled to the other end of the body, an ignition member in the body and the cap which can be pulled to ignite the igniter composition and a safety shield at least partially receiving the body and the cap and having opposite ends with a first of said ends being adjacent the cap, said safety shield being releasably retained against substantial axial movement relative to the body in a retracted position to inhibit removal of the cap from the body and being responsive to a force to move relative to the body and cap to an extended position whereby removal of the cap from the body is facilitated, said body having an annular surface and said cap having an annular surface confronting said annular surface of said body, the improvement comprising:

said annular surfaces of said body and said cap cooperating to define an annular seal groove;

an annular seal in said seal groove; and said annular surface of said body having a concavely curved surface for capturing the seal.

14. A flare as defined in claim 13 wherein said cap has an annular end face defining the concavely curved surface.

* * * * *